US005082266A

United States Patent [19]

Lo

[11] Patent Number: 5,082,266

[45] Date of Patent: Jan. 21, 1992

[54] RACKET HEAD WITH INNER PERIPHERAL INDENTATIONS

[76] Inventor: Kun-Nan Lo, No. 33, Hsiang-Ho Rd., Li-Lin Tsun, Tan-Tsu Hsiang, Taichung Hsien, Taiwan

[21] Appl. No.: 575,033

[22] Filed: Aug. 30, 1990

[51] Int. Cl.[5] ..... A63B 49/00

[52] U.S. Cl. ..... 273/73 D

[58] Field of Search ..... 273/73 R, 73 A, 73 C, 273/73 D, 73 E

[56] References Cited

U.S. PATENT DOCUMENTS 2,230,177 1/1941 Caines ..... 273/73 D 4,333,650 6/1982 Soong ..... 273/73 D 4,408,760 10/1983 Ferrari ..... 273/73 D

*Primary Examiner*—William H. Grieb

*Attorney, Agent, or Firm*—Panitch Schwarze Jacobs & Nadel

[57] ABSTRACT

A looped racket frame has two frame portions which are symmetrically opposite with respect to the longitudinal axis of the frame to hold some transverse string lines passing through a central area of the string web. These opposite frame portions are provided with two elongated indentations at the inner peripheries thereof to enlarge the distance between the string holes which hold the transverse string lines, thereby lengthening the string lines passing through the central area.

2 Claims, 4 Drawing Sheets

RACKET HEAD WITH INNER PERIPHERAL INDENTATIONS

BACKGROUND OF THE INVENTION

This invention relates to a racket frame, and particularly to a looped head of the racket with two symmetrically opposite inner peripheral indentations with respect to the longitudinal axis of the looped frame.

A conventional looped racket frame generally has an outer grooved peripheral face extending along the length of the looped head and a substantially convexed opposite inner peripheral face, wherein the string lines of the racket run to and fro passing through the string holes from the inner peripheral face to the outer grooved peripheral face which provides a channel to guide the string to turn inward. The looped frame is generally oval-shaped which has a longitudinal axis and a transverse axis.

Generally, the direction of a ball stroke by a racket depends of the characteristics of the string web and the point on the string web where the ball strikes. The angle of deflection of individual string lines relative to the plane of the string web formed upon striking the ball is one of the important characteristics of the string web. The deflection angles of the string lines are not identical since the lengths of the string lines are different depending on their positions in the looped frame. FIGS. 1 to 5 show the deflection angles of different string lines when a ball strikes at P1, P2, P3 and P4 on the string web.

When the ball impacts at the point P1, the center of symmetry of the looped frame, the ball will generally be rebounded in a direction perpendicular to the string web without deviation. This point is the best point that permits the player to best predict the direction of the ball. When the ball impacts points other than the point P1, the directions of the rebound becomes difficult to predict. This is because the the striking points bisect both the longitudinal and transverse strings into segments of unequal length and thus will cause different deflection angles of the strings with respect to the string web. The different deflections of the two string portions on two sides of the point cause the rebound ball to uncontrollably deflect from the vertical line with respect to the string web.

Referring to FIGS. 2 and 3 in combination with FIG. 1, the impact points P2 and P3 are on different longitudinal lines AA and BB but on the same transverse line CC. The line BB is longer than the line AA and thus the line BP3 is longer than the line AP2. Therefore, the deflection angle $\theta 2'$ of the longer line BP3 is smaller than the angle $\theta 1'$ of the shorter line AP2. As a result, the deflection angle $\theta 2$ of the ball rebounded from the longer string BB is smaller than the angle $\theta 1$ of the ball rebounded from the shorter string AA. Similarly, FIGS. 4 and 5 shows different angles of deflection of the balls occurring at points P2 and P4 on a shorter transverse lines CC and a longer transverse line DD.

In view of the above facts, a general conclusion can be made such that the longer in the string line is the smaller in the deflection angle of the ball. As a matter of fact, the direction of a ball is not merely affected by a deflected single line but by several deflected string lines including longitudinal and transverse lines. Therefore, the direction of the ball depends on the total effect of the strings impacted by the ball, which renders the direction of the ball difficult to predict. In order to easily control the ball, it is desirable to minimize the deflection angles of the ball imparted by the string web. To this end, it is necessary to lengthen the strings.

SUMMARY OF THE INVENTION

An object of the invention is to provide a racket frame with an improvement which permits some transverse string lines passing through the central striking area of the racket to be lengthen without altering the original size of the racket head so that the deflection at the central striking area of the racket head is minimized.

This and other objects can be achieved by the provision of a looped racket head which has two elongated indentations respectively provided in the inner peripheries of two frame portions which are symmetrically opposite with respect to the longitudinal axis of the head. The opposite frame portions hold some of transverse string lines passing through a central area of the string web of the head which is an effective striking area of a racket. The elongated inner grooves provide added distance between the opposite frame portions and effectively lengthen some of the transverse string lines.

The exemplary preferred embodiment will be described in detail with reference to the accompanying drawings, in which:

DETAILED DESCRIPTION OF THE PREFERRED EMBODIMENT

Figure 1:
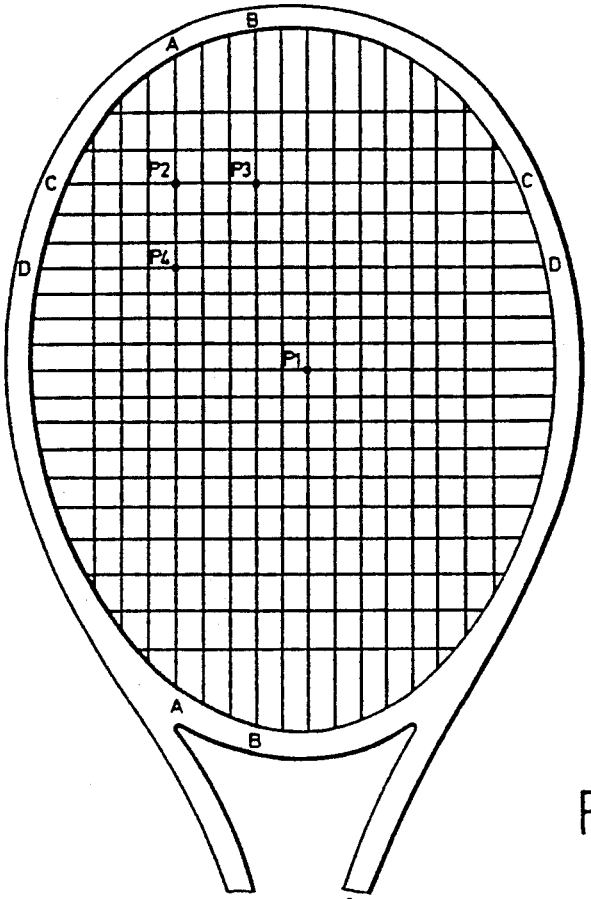
FIG. 1 PRIOR ART
FIGS. 1 to 5 show a conventional racket and the deflections of the strings when impacted by a ball.
Figure 2:
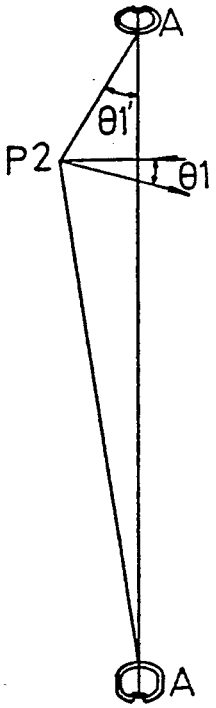
FIG. 2 PRIOR ART
Figure 3:
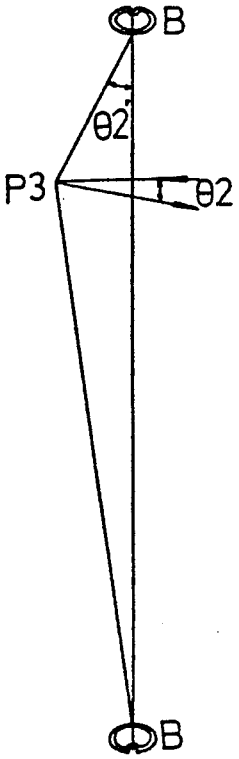
FIG. 3 PRIOR ART
Figure 4:
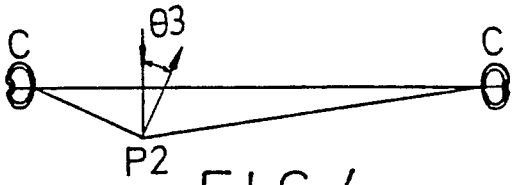
FIG. 4 PRIOR ART
Figure 5:
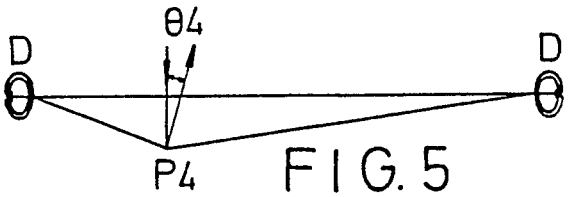
FIG. 5 PRIOR ART
Figure 6:
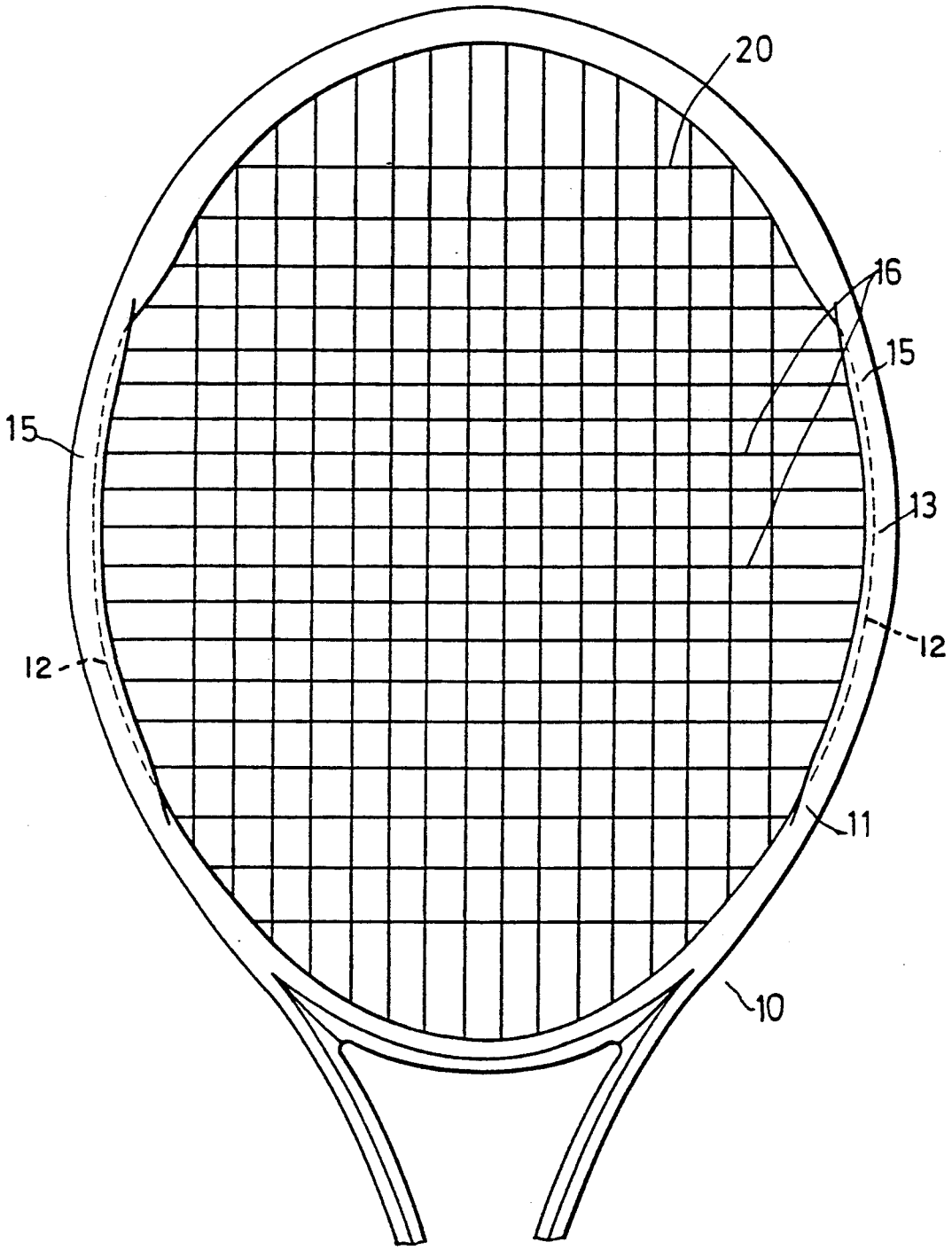
FIG. 6 is an elevation view of a looped racket head incorporating the present invention.
Figure 7:
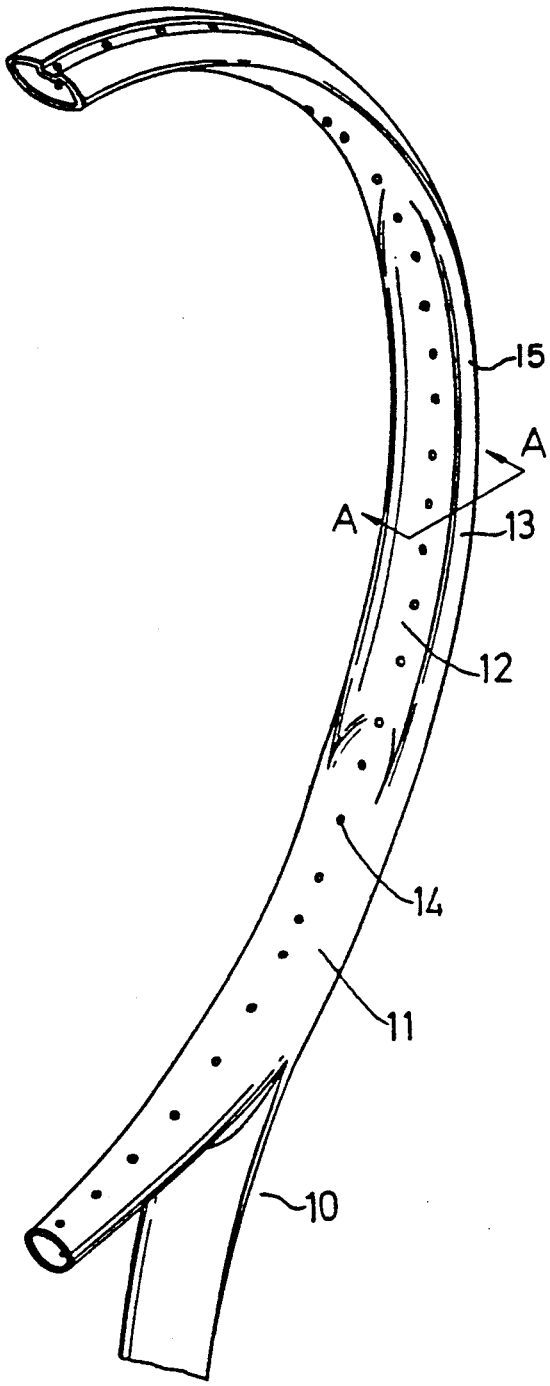
FIG. 7 is a perspective view of a portion of the racket head of FIG. 6.
Figure 8:
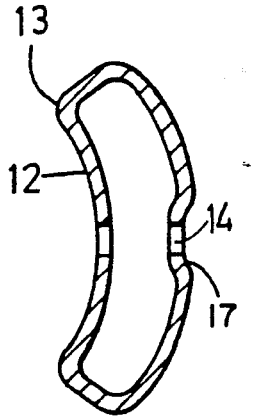
FIG. 8 is a sectional view taken along line A—A of FIG. 7.

Referring to FIGS. 6 to 8, a racket 10 has a substantially oval-shaped racket head 11. A string web 20 is attached to the head frame 11 through string holes 14 bored from the inner periphery to the outer periphery of the frame. The outer periphery of the frame 11 has a peripheral groove 17 extending substantially the full length of the looped frame 11. The inner periphery of the head 11 has two frame portions 15, each of which has two elongated indentations 12 which are symmetrically opposite with respect to the longitudinal axis of the head. The frame portions 15 hold some transverse string lines 16 which pass through a central area of the string web 20. Reinforcing ridges 13 are formed on either side of each elongated indentation 12.

Figure 9:
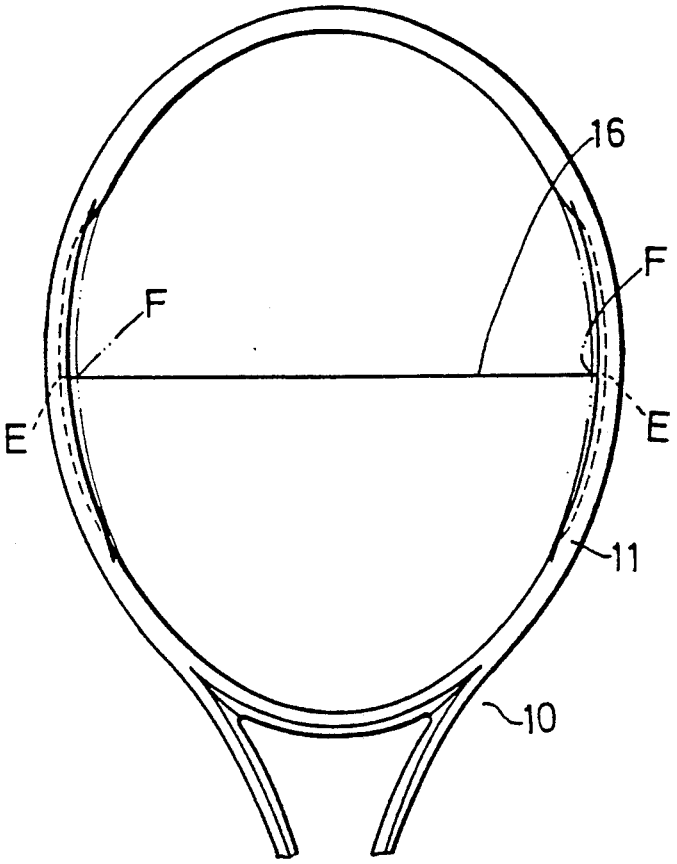
FIG. 9 compares the string lines of the present invention with those of the prior art.

Referring to FIG. 9, it can be appreciated that line EE, i.e. the distance between two opposite string holes at points E, E in the frame portions 15, is longer than line FF which is the distance between two opposite string holes in a racket head without the indentations 12 of the present invention. That is to say, the strings 16 are lengthened because of the indentations 12. The longer string lines 16 minimize the deflection angle of the ball which hits the central area of the racket head, thereby enabling the user to predict the direction of the ball more easily than with a conventional racket of the same size.

With the invention thus explained, it is apparent that various modifications and variations can be made without departing from the scope of the invention. It is therefore intended that the invention be limited only as indicated in the appended claims.

I claim:

1. A racket frame comprising:

a looped head having an inner periphery, an opposite outer periphery, a plurality of string holes extending from said inner periphery to said outer periphery, and a string web held by said looped head and having longitudinal and transverse string lines passing through said string holes, said looped head having two frame portions which are symmetrically opposite with respect to a longitudinal axis of the looped frame, said frame portions holding some of said transverse string lines which pass through a central area of said string web, and two elongated indentations respectively provided in said frame portions at said inner periphery, said elongated indentations providing an added distance between some of said string holes through which said some of said transverse string lines pass, thereby elongating said some of said transverse string lines.

2. A racket frame as claimed in claim 1, wherein each of said frame portions has two reinforcing ridges on two sides of said indentation of each of said frame portions.

* * * * *